US005174177A

United States Patent [19]

Jeromson, Jr. et al.

[11] Patent Number: 5,174,177

[45] Date of Patent: Dec. 29, 1992

[54] REVERSIBLE SNAP RING PLIERS

[75] Inventors: James R. Jeromson, Jr., Aurora; Richard E. Potesta, Chesterland, both of Ohio

[73] Assignee: Milbar Corporation, Chagrin Falls, Ohio

[21] Appl. No.: 665,305

[22] Filed: Mar. 5, 1991

Related U.S. Application Data

[63] Continuation-in-part of Ser. No. 378,448, Jul. 10, 1989, Pat. No. 5,007,313, which is a continuation of Ser. No. 182,016, Apr. 29, 1988, abandoned, which is a continuation-in-part of Ser. No. 46,851, May 7, 1987, abandoned.

[51] Int. Cl.[5] ..... B23P 19/04

[52] U.S. Cl. ..... 81/486; 29/225; 29/229; 81/485; 81/302

[58] Field of Search ..... 29/225, 229; 81/416, 81/417, 485, 486, 302

[56] References Cited

U.S. PATENT DOCUMENTS

| | | | |
|---|---|---|---|
| 2,483,380 | 9/1949 | Duffy | 29/229 |
| 2,483,383 | 9/1949 | Heimann et al. | 81/5.1 |
| 2,546,616 | 3/1951 | Schaaff | 29/229 |
| 2,562,128 | 7/1951 | Sawdy | 29/229 |
| 2,977,674 | 4/1961 | Arthur | 29/229 |
| 3,040,420 | 6/1962 | Kulp | 29/229 |
| 3,091,841 | 6/1963 | Wurzel | 29/229 |
| 3,271,847 | 9/1966 | Millheiser | 29/229 |
| 3,619,890 | 11/1971 | Kubokawa | 29/229 |
| 3,662,449 | 5/1972 | Hashimoto | 29/229 |
| 3,681,840 | 8/1972 | Pool | 29/229 |
| 3,762,019 | 10/1973 | Epstein | 29/229 |
| 4,280,265 | 7/1981 | Murphy | 29/229 |
| 4,316,315 | 2/1982 | Vogelnik | 29/229 |
| 4,476,750 | 10/1984 | Murphy | 81/300 |
| 4,621,401 | 11/1986 | Anderson | 29/229 |
| 4,625,379 | 12/1986 | Anderson | 29/229 |

FOREIGN PATENT DOCUMENTS

| | | |
|---|---|---|
| 1267166 | 11/1959 | France . |
| 1334877 | 10/1973 | United Kingdom . |

*Primary Examiner*—J. J. Swann

*Attorney, Agent, or Firm*—Watts, Hoffmann, Fisher & Heinke Co.

[57] ABSTRACT

A hand tool including a pair of levers each including a handle portion, a jaw portion and a boss portion interconnecting the handle and jaw portions, with the levers being pivotally interconnected for normally permanently intended but relatively movable relationship. The lever sections are pivotally interconnected together along the boss portions for manipulation between internal and external tool operating positions. Movement between the internal and external positions is provided by a rotatable eccentric knob. The knob carries a spring biased lock for securing the levers in a selected one of its operating positions.

9 Claims, 3 Drawing Sheets

REVERSIBLE SNAP RING PLIERS

CROSS REFERENCES

This application is a continuation-in-part of application Ser. No. 07/378,448 filed Jul. 10, 1989 entitled "Hand Tool" now U.S. Pat. No. 5,007,313. That application was a continuation of Ser. No. 07/182,016 filed Apr. 29, 1988 which was, in turn, a continuation-in-part of Ser. No. 07/046,851 filed May 7, 1987, the latter two both being abandoned.

TECHNICAL FIELD

This invention relates to a hand tool of the type used for expansion and/or contraction of differing types of deformable members.

BACKGROUND ART

Snap or retaining rings are either "internal" or "external". The internal type of retaining ring is used to retain elements such as bearings or shafts, within a bore. In order to install the ring it is contracted to allow it to pass into the bore, and then allowed to expand for engagement with an internal groove formed around the bore. The external type of retaining ring is used to retain elements such as bearings, gears or pulleys on shafts. An external ring normally engages an annular groove formed in a shaft to inhibit axial movement of an element mounted on the shaft. An external ring is installed by expanding the ring until its internal diameter is greater than the shaft diameter.

The tools typically used for installing and removing internal and external rings are substantially different. A tool for installing and removing external rings, for example, must expand the ring to increase its internal diameter in order to accommodate the shaft. An internal ring installation and removal tool, however, must contract the ring in order to decrease its external diameter to enable the ring to pass through a bore. Since the function and performance required of such tools is so substantially different, retaining ring pliers are often supplied as single purpose "internal" and "external" tools. These single purpose pliers are intended for use only in installing or removing one type of retaining ring, and both types of pliers are therefore required in order to install or remove both external and internal types of retaining rings.

One solution to the provision of a tool suitable for either internal or external rings has been the provision of convertible tools capable of switching between internal and external positions. These required manipulation of interconnected pieces, movement of a linkage arrangement mounted on the tool or disassembly of jaw and/or handle sections in order to accomplish the conversion.

One such convertible tool, known as a universal plier, is illustrated in U.S. Pat. No. 4,625,379 issued Dec. 2, 1986 to J. E. C. Anderson. The tool includes a pair of pivotally interconnected handles and a pair of jaw members coupled to the handles by a latching mechanism having two transversely slidable latch members. In one position, the latch members are positioned to allow one handle member to be coupled to one jaw member and the other handle to be coupled to the other jaw member. Upon transversely sliding the latch members to a second position, the one handle is coupled to the other jaw member and the other handle is coupled to the one jaw member. While the construction of the referenced patent has enjoyed great success, it is relatively complex and it contains numerous parts which must be properly assembled and aligned during operation to provide proper functioning.

In a substantially different construction, a plier is provided whereby separate pairs of jaws and handles are pivotally interconnected about a common axis and are arranged such that a pair of movable pins is adapted to alternately engage the jaw and handle pairs to shift the jaw and handle interconnections from an internal position to an external position and visa versa.

An additional form of plier construction provides interconnected levers having two jaw members for simultaneous operation of the tool on internal and external retaining rings by a pair of jaws positioned for internal operation and a pair of jaws for external operation.

Another convertible plier construction utilizes linkages that must be disengaged and the tool reassembled in order to change the relationship between the handles and jaws. Such a construction is cumbersome to use as it requires unneeded preparation time prior to use, and may alter the configuration of the tool such that it becomes uncomfortable to use. In addition at least some such tools have significantly different mechanical advantages in the internal and external positions.

A proposed tool provided handles which were intended to be relatively moveable between internal and external positions. To accomplish this one lever included a U-shaped slot and the other carried a pivot which projected through the slot. Presumably the levers can be moved from a crossed internal ring relationship with the pivot at one end of the slot to a side by side external ring relationship. If the proposed tool was operable at all, it lacked structure to maintain the levers in a selected relationship when in use.

SUMMARY OF INVENTION

The present invention provides a new and improved hand tool for removing and installing internal and external retaining rings. The tool includes two levers permanently connected together which nonetheless may be easily switched between internal and external operating positions.

In one position reaction forces resulting from a work operation apply a position retention force to maintain the levers in a selected relationship while a work operation is performed. In the other position reaction forces tend to move the tools out of that position. With the tool of this invention, a positive lock is provided in each position.

The tool comprises right and left operating lever sections pivotally interconnected together with a driving structure for shifting the lever sections between tool operating positions. Each of the lever sections includes a jaw portion, a handle portion and a boss portion intermediate the haw and handle portions.

The lever sections are in a side by side relationship during operation of the tool in the external position. Thus, both the jaw and handle portions of the one lever section operate on one side of a center line, while the jaw and handle portions of the other lever are on the other side of the center line. When in the internal operating position, the portions are crossed such that the jaw and handle portions of the one lever operate on opposite sides of the center line, and the jaw and handle portions of the other lever are also opposite one another relative to the center line.

One lever section and the driving structure, which comprises a driving knob, are coupled together so that the other lever section moves relative to the one lever section and the driving knob. As a result of this construction, when the tool is in the external position, the lever sections are crossed. When the driving knob is manually rotated to shift the levers for operation in the internal position, the lever sections move to opposite sides of the center line in side by side relationship.

The driving knob includes a handle portion, a lever engagement portion and a base portion disposed in a circular recess in one of the levers. A pivot connects that base portion to the other lever in eccentric relationship. To move the tool between external and internal positions, the handle portion of the knob is manually rotated to cause eccentric relative lever movement so that one jaw tip passes by the other.

With the tool of this invention, internal and external lock notches are formed in the one lever. These notches communicate with, and project circumferentially outwardly from, the circular recesses.

A spring biased lock is carried by the knob. When a shifting of the tool from one position to the other is desired, an operator depresses the lock and then rotates the knob. Rotation is continued until the lock is radially aligned with a notch. The spring bias on the lock drives the lock into the aligned recess which locates the tool in one of its two working positions.

These and other features and advantages of the present invention will be had by referring to the following description and claims taken in conjunction with in the accompanying drawings.

BEST MODE FOR CARRYING OUT THE INVENTION

Figure 1:
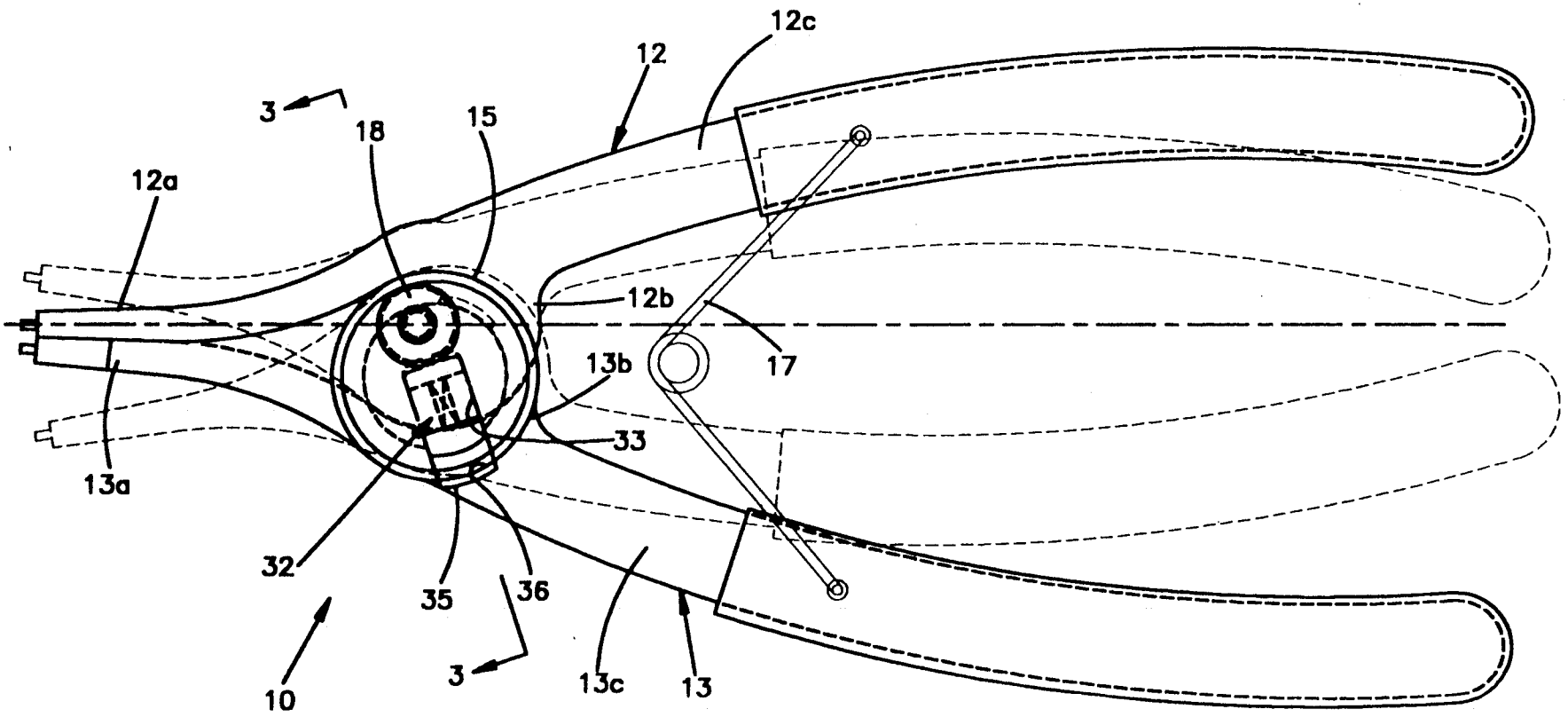
FIG. 1 is a plan view of the plier tool of this invention in its external ring orientation showing, in solid lines, the position of the tool prior to use and in phantom lines, the position of the tool after a ring has been grasped and spread.
Figure 2:
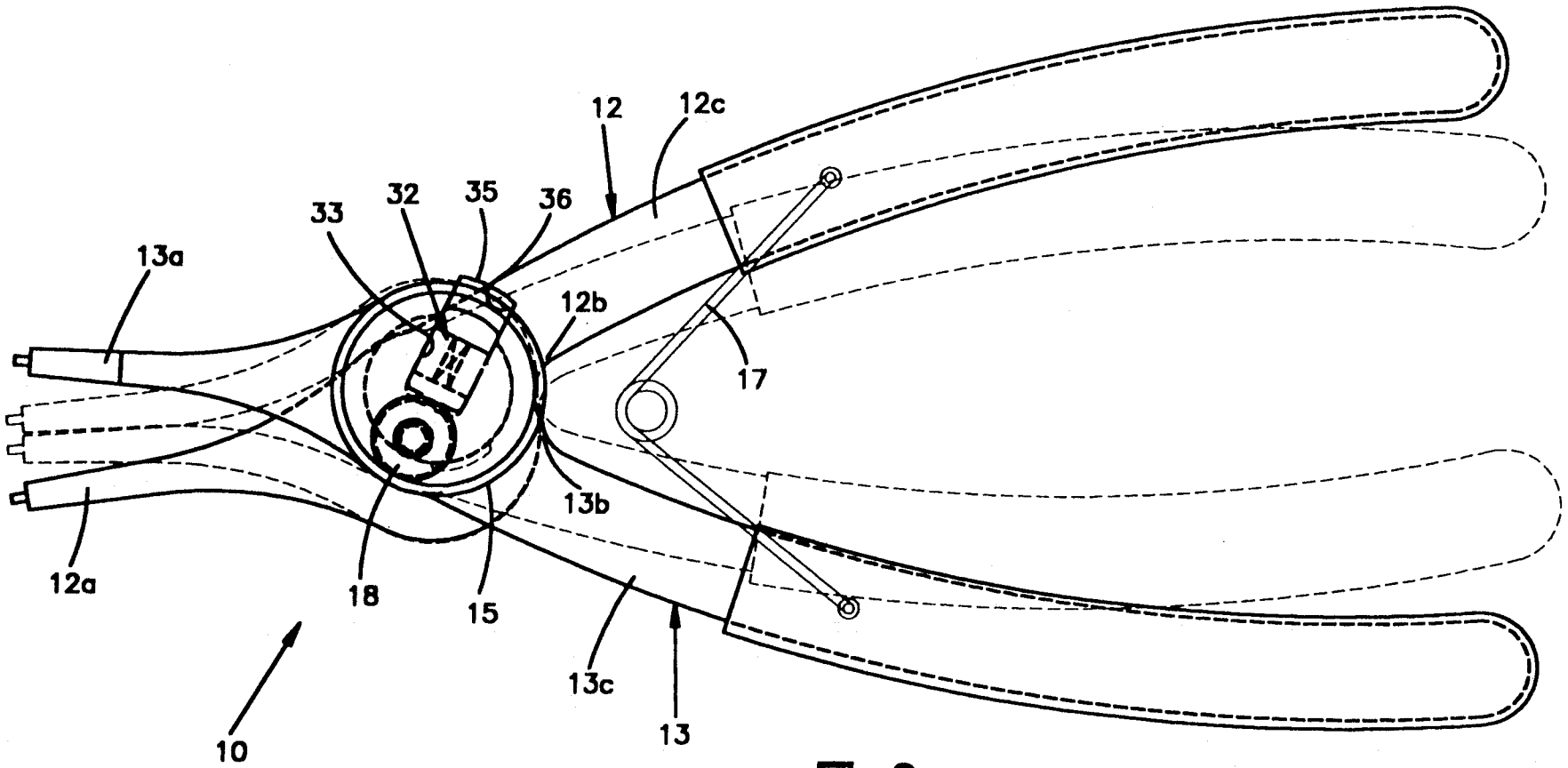
FIG. 2 is a plan view of the plier tool of this invention in its internal ring orientation showing, in solid line lines, its position prior to use and in phantom lines, its position when a ring has been grasped for insertion or removal.
Figure 4:
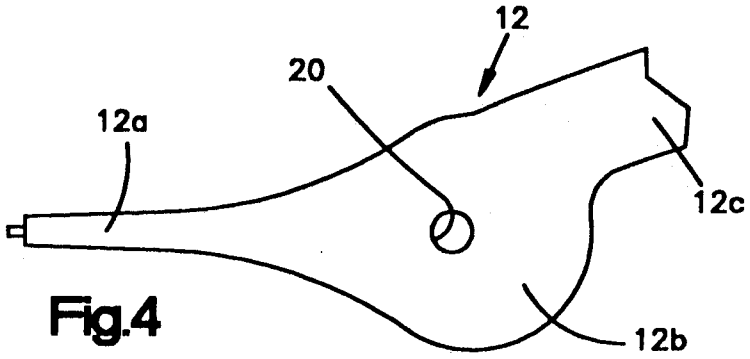
FIGS. 4 and 5 are fragmentary plan views of portions of the lever members of the tool of this invention.

Referring to the drawings in FIGS. 1 and 2 in particular, a snap ring plier tool is shown generally 10. The tool includes a pair of interconnected handles 12, 13. The handles respectively include tip portions 12A, 13A, boss portions 12B, 13B and handle portions 12C, 13C. In the preferred and disclosed arrangement, the handles 12, 13 are steel stampings.

The handles may be relatively positioned in the side by side relationship as shown in FIG. 1 for installing and removing external snap rings. Movement of a control knob 15, is effective to shift the handles from their side by side external position relationship of FIG. 1 to the crossed internal ring configuration of FIG. 2. In either position a spring 17 interconnected between the handle portions 12C, 13C functions to bias the handle portions apart.

A rivet 18 is provided. The rivet of 18 extends through an aperture 20 formed in the boss portion 12B and through ana aligned aperture 21 in the knob 15. The rivet has a staked-over portion 23 positioned in a recess 24 in the knob 15. The staked-over portion 23 functions to secure the handle 12 and the knob 15 together in relatively rotatable relationship. The boss portion 13B of the handle 13 is trapped between the boss portion 12B and an overlying shoulder 26 of the knob 15 which functions as a lever connection maintenance structure.

Figure 5:
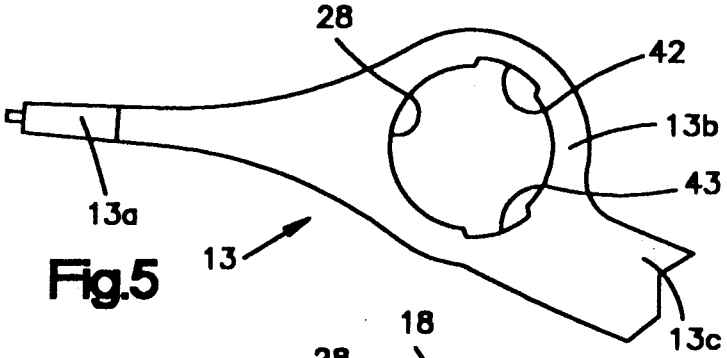
Figure 6:
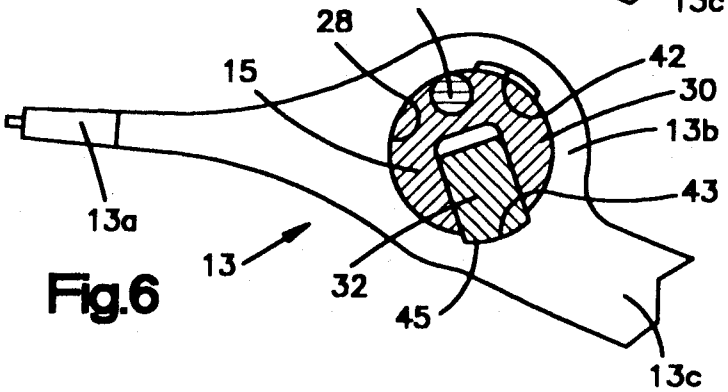
FIG. 6 is a sectional view on the scale of FIGS 4 and 5 as seen from the plane indicated by the line 6—6 of FIG. 3.
Figure 3:
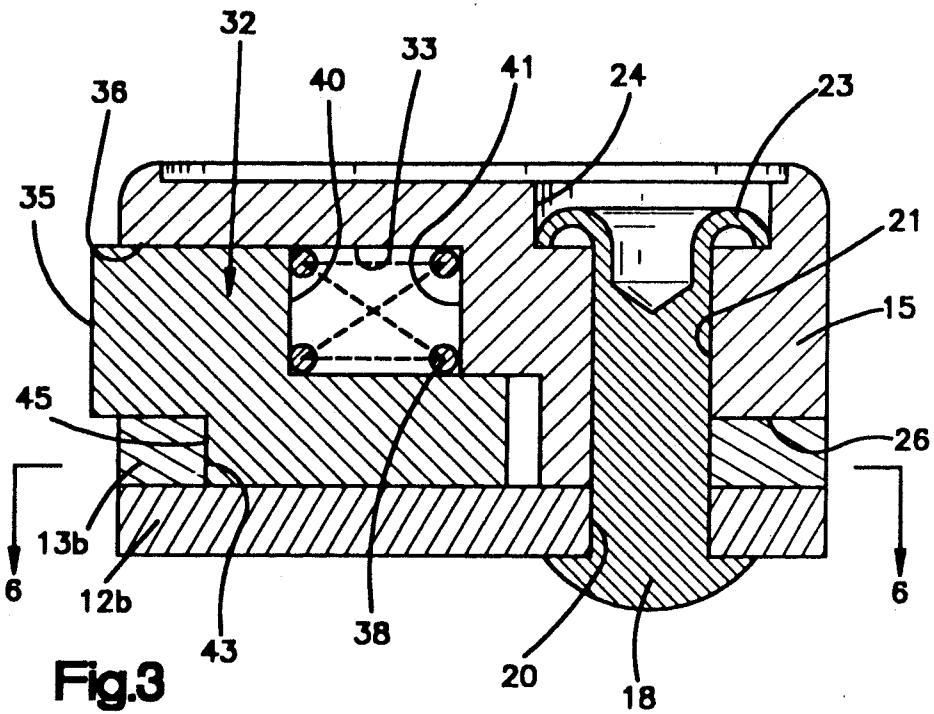
FIG. 3 is a sectional view on an enlarged scale as seen from the plane indicated by the line 3—3 of FIG. 1.
Figure 7:
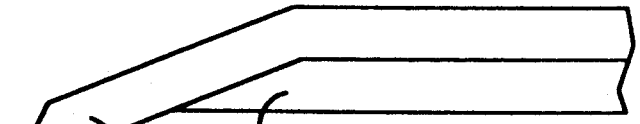
FIG. 7 is a fragmentary side elevational view, on an enlarged scale, of the tip portions of the plier tool when in the external ring orientation of FIG. 1.

As is best seen in FIG. 5, the boss portion 13B includes a circular recess 28. The knob includes a lower complemental circular portion 30 which fits closely within the aperture 28, such that the knob is concentric with the aperture. As is best seen from FIG. 3, the rivet connection of the knob to the boss portion 12B is eccentric with respect to the circular portion. Thus, on rotation of the knob 15, there is an eccentric action which will move the tip portions 12A, 13A relatively past one another to shift the levers from the eternal ring position of FIG. 1 to the internal ring position of FIG. 2 and vice versa. Since the rivet, as shown, is staked over to position and maintain the levers in juxtaposed relationship when this relative motion occurs, the levers are maintained in sliding relationship.

When the plier tool 10 is functioning to install or remove an external ring, reaction forces tend to shift the levers 12, 13 relatively out of the adjusted position of FIG. 1. One of the outstanding features of this invention is the provision of the positive lock element 32 that is positioned within a recess 33 in the knob 15. The lock 32 includes a manually accessible button portion 35 that projects through an opening 36 in the knob 15. The lock 32 is biased outwardly to the position shown in FIGS. 1 and 3 by a spring 38 captured between shoulders 40, 41 on the lock and knob respectively.

Referring again to FIG. 5, internal and external tool positioning notches 42, 43 are provided. The spring 38 biases the lock 32 outwardly into these notches selectively and one at a time when the lock is aligned with the notches. To this end, as one can see from FIG. 5, the notches communicate with the aperture 28 and extend outwardly from that aperture.

Referring again to FIG. 3, the lock 32 is shown with a shoulder 45 extending into an engagement with a circumferential wall of the notch 43 and thus, the tool is locked in the external ring position of FIGS. 1 and 3. To shift the tool from its external to its internal position, an operator presses on the button portion 35 to compress the spring 38 and move the shoulder 45 out of the recess 43. The knob 15 is then rotated to shift the tool from its external to its internal ring position of FIG. 2. Upon the lock 32 becoming aligned with the notch 42, the lock 32 will be biased into that notch to lock the tool in its internal ring position.

Although one embodiment of the present invention has been illustrated and described, the present invention is not to be considered limited to the precise embodiment disclosed. Various adaptations, modifications and uses of the invention may occur to those skilled in the art to which the invention relates and the intention is to cover all such adaptations, modifications and uses which fall within the spirit or scope of the appended claims.

I claim:

1. A plier tool comprising:

a) a pair of levers each including a handle portion, a jaw portion including a tip and a boss portion fixedly interconnecting the handle and jaw portions;

b) a pivot interconnecting the levers in a permanently intended, boss portion juxtaposed, but relatively movable relationship;

c) the tool including a work position selection means selectively to cause the shifting of the levers in a sliding motion as the boss portions are maintained in their juxtaposed relationship by the pivot, the motion including relative longitudinal movement of the levers such that one tip is passed by the other as the levers are moved between a first working position in a crossed relationship and a second working position in a side by side relationship and such said one tip is passed by the other as the levers are moved from the second to the first position; and, d) the work position selection means including a circular section rotatively and complementally disposed in a circular recess formed in a section of one of the bosses, a lock element moveably connected to one of the sections, the other of sections including a locking notch having walls for selectively engaging part of the lock element, the lock element part, when engaging said walls pre-venting relative section rotation and thereby locking the tool in the first working position, and relative section rotation is enabled when the lock element is moved to withdraw the lock element part from the notch.

2. The plier tool of claim 1 wherein there are a spaced pair of locking notches having walls for selective engagement by the lock element part whereby the tool may be selectively locked one at a time in the first and the second working positions.

3. A convertible snap ring plier tool comprising:

a) a pair of levers each including jaw and handle portions interconnected by a boss portion;

b) each of the jaw portions including a tip to engage a snap ring;

c) one of the boss portions including walls defining a circular aperture;

d) a knob including a circular portion complementally disposed in the aperture;

e) a pivot eccentrically interconnecting the knob and the other of the boss portions;

f) the knob also including lever connection maintenance structure overlying at least a part of the one boss portion with the one boss portion interposed between the structure and the other boss portion to maintain the levers in an interconnected condition;

g) the knob being rotatable to cause relative lever movement between internal and external ring work position orientations;

h) the one boss portion also including a spaced pair of locking notches communicating with and projecting radially from the circular aperture, the notches being internal and external work position locators respectively; and, i) a spring biased lock element carried by the knob to project into locking relationship with said notches selectively and one at a time.

4. The plier tool of claim 3 wherein the lever connection maintenance structure comprises a circular flange axially aligned with the circular portion.

5. The tool of claim 3 wherein the lock element includes opposed operator control and spring engagement surfaces and wherein the lock element is moveable out of a locking relationship on application of manual pressure on the operator control surface.

6. A convertible snap ring plier tool comprising:

a) a pair of levers each including jaw and handle portions interconnected by a boss portion;

b) each of the jaw portions including a tip to engage a snap ring;

c) one of the boss portions including walls defining a circular aperture;

d) a knob including a circular portion complementally disposed in the aperture;

e) means for eccentrically interconnecting the knob and the other of the boss portions;

f) the knob also including lever connection maintenance structure overlying at least a part of the one boss portion with the one boss portion interposed between the structure and the other boss portion to maintain the levers in an interconnected condition;

g) the knob being rotatable to cause relative lever movement between internal and external ring work position orientations;

h) the one boss portion also including a spaced pair of locking notches communicating with and projecting radially from the circular aperture, the notches being internal and external work position locators respectively;

i) a lock element slidably carried by the knob and including notch engagement surfaces, the element being shiftable rom a notch engagement position to a release position on manual application of pressure; and, j) a spring interposed between the spring engagement section and the element and biasing the element toward its engagement position.

7. A convertible snap ring plier tool comprising:

a) a pair of levers each including jaw and handle portions interconnected by a boss portion;

b) each of the jaw portions including a tip to engage a snap ring;

c) one of the boss portions including walls defining a circular aperture;

d) a knob including a circular portion complementally disposed in the aperture;

e) means for eccentrically interconnecting the knob and the other of the boss portions;

f) the tool also including lever connection maintenance means to maintain the levers in an interconnected condition;

g) the knob being rotatable to cause relative lever movement between internal and external ring work position orientations;

h) the one boss portion also including at least one locking notch communicating with and projecting radially from the circular aperture, the notch being a work position locator; and, i) a spring biased lock element carried by the knob to project into locking relationship with said notch.

8. The tool of claim 7 wherein the lock element includes opposed operator control and spring engagement surfaces and wherein the lock element is moveable out of a locking relationship on application of manual pressure on the operator control surface.

9. The tool of claim 7 wherein there are a spaced pair of locking notches which are internal and external work position locators respectively, and the lock element is projectable into locking relationship with the notches selectively and one at a time.

* * * * *